United States Patent [19]

Ping

[11] 4,227,449

[45] Oct. 14, 1980

[54] PUNCHING PRESS

[76] Inventor: Leu C. Ping, No. 74, Jong Shiaw Rd., Baan Chyau, Taiwan

[21] Appl. No.: 34,396

[22] Filed: Apr. 30, 1979

[51] Int. Cl.[3] ..... B30B 1/26; B30B 15/32

[52] U.S. Cl. ..... 100/98 R; 100/218; 100/266; 100/282; 100/295; 83/127

[58] Field of Search ..... 100/218, 266, 282, 292, 100/295, 98 R; 83/123, 125, 127

[56] References Cited

U.S. PATENT DOCUMENTS 3,662,640 5/1972 Wrona ..... 100/292 X

FOREIGN PATENT DOCUMENTS 537659 5/1955 Belgium ..... 100/282

*Primary Examiner*—Billy J. Wilhite

[57] ABSTRACT

An improved punching press employing a crank shaft, two crank arms having wide longitudinal surfaces for driving to a pressure head connected with a slide, and a crank pin connecting punch ram so as to complete the procedures of pressing and punching during one revolution of the crank shaft.

3 Claims, 5 Drawing Figures

PUNCHING PRESS

BACKGROUND OF THE INVENTION

1. Field of the Invention

This invention relates to an improved punching press, and more particularly, to a punching press wherein the procedures of pressing, punching, and pushing the product apart from dies can be completed during one turn of a crank shaft.

2. Description of the Prior Art

Most conventional presses adapt a crank shaft and a connecting means to drive a flywheel to convert the rotational energy into reciprocating power, in which the crank may be in the form of a single crank-pin type or a multiple crank-pin type. FIG. 1*a* shows a crank being usually used in the conventional presses which has a crank pin 3, two crank arms 2 and a crank shaft 1. The crank pin 3 is coupled with one end of a connecting rod (not shown) so as to make an eccentric rotation, another end of the connecting rod is engaged with a screw rod attached to a slide so that the slide may move reciprocally in downward or upward direction so as to perform the procedure of metal deformation. Additionally, the crank arms are usually provided with a counter balance weight so as to make the rotation of the crank shaft 1 smooth. However, an outstanding disadvantage of the previous presses is that only one power stroke will be generated for one revolution. Therefore, it is impossible to finish a product which needs to be both punched and pressed in one operation.

FIG. 1*b* shows a crank for the conventional press having two crank pins, four crank arms 5 and a crank shaft 1. Although the presses provided with the crank may generate two power strokes during one turn of the crank shaft, the cost, occupied space, complexity of construction and possibility of damage is also increased.

SUMMARY OF THE INVENTION

According to the present invention, there is provided a punching press comprising a crank including a crank pin for actuating a ram, a crank shaft, and two crank arms attached to two ends of the crank pin respectively and having wide longitudinal surfaces attaching to a pressure head engaged with a screw rod which is coupled with a slide; a cam coupled with one end of the crank shaft to drive a connecting means to push the product apart from the dies; and a flywheel and a clutch means provided at another end of the crank shaft; wherein two sides of the upper end of the pressure heads are provided with a stem respectively, and one end of each stem protrudes through a hollow guide tube provided between a top plate of a frame and one side of the pressure heads and is positioned by a compression spring provided on the top plate of the frame. Therefore, during the crank shaft's revolution the crank arms will firstly actuate the pressure heads to move the screw rods and the slide downwardly so as to perform the pressing procedure, the crank pin will then move the ram downwardly to punch a workpiece under a desired condition, and the cam provided on one end of the crank shaft will finally drive a pushing rod coupled with the connecting means to push the product to leave the dies.

It is an important object of the present invention to provide a punching press comprising a crank having a crank pin, wherein the pressing and punching procedures may be completed in one turn of the crank shaft while performing steps which require two or more turns by a single type crank pin of the conventional press, or in one turn by a multiple-type crank pin of the conventional press. The cost, occupied space, and complexity of construction, may be reduced.

It is a further object of the present invention to provide a punching press having a cam provided at one end of the crank shaft so as to push the product to leave the dies after the processes of metal deformation is completed.

Other objects and aspects of the present invention will become apparent from the following description of a preferred embodiment with reference to the accompanying drawings in which:

FIG. 1*a* diagrammatically illustrates a single-type crank pin used in the conventional press;

FIG. 1*b* diagrammatically illustrates a multiple-type crank pin used in the conventional press;

DETAILED DESCRIPTION OF THE PREFERRED EMBODIMENT

Figure 1A:
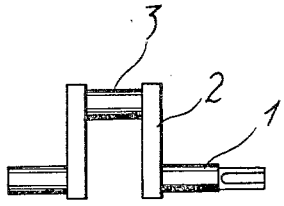
Fig. 1a (PRIOR ART)
Figure 1B:
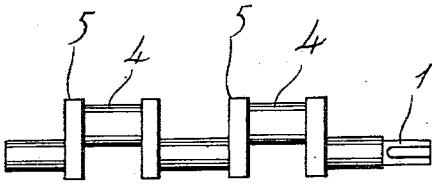
Fig. 1b (PRIOR ART)
Figure 2:
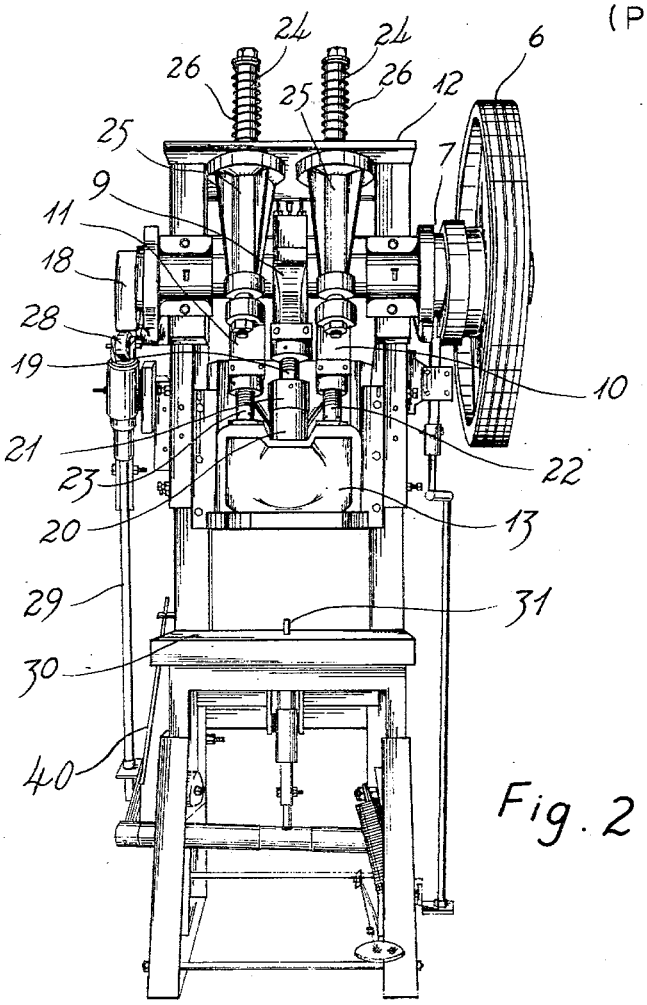
FIG. 2 is a perspective view of a preferred embodiment of the present invention.
Figure 3:
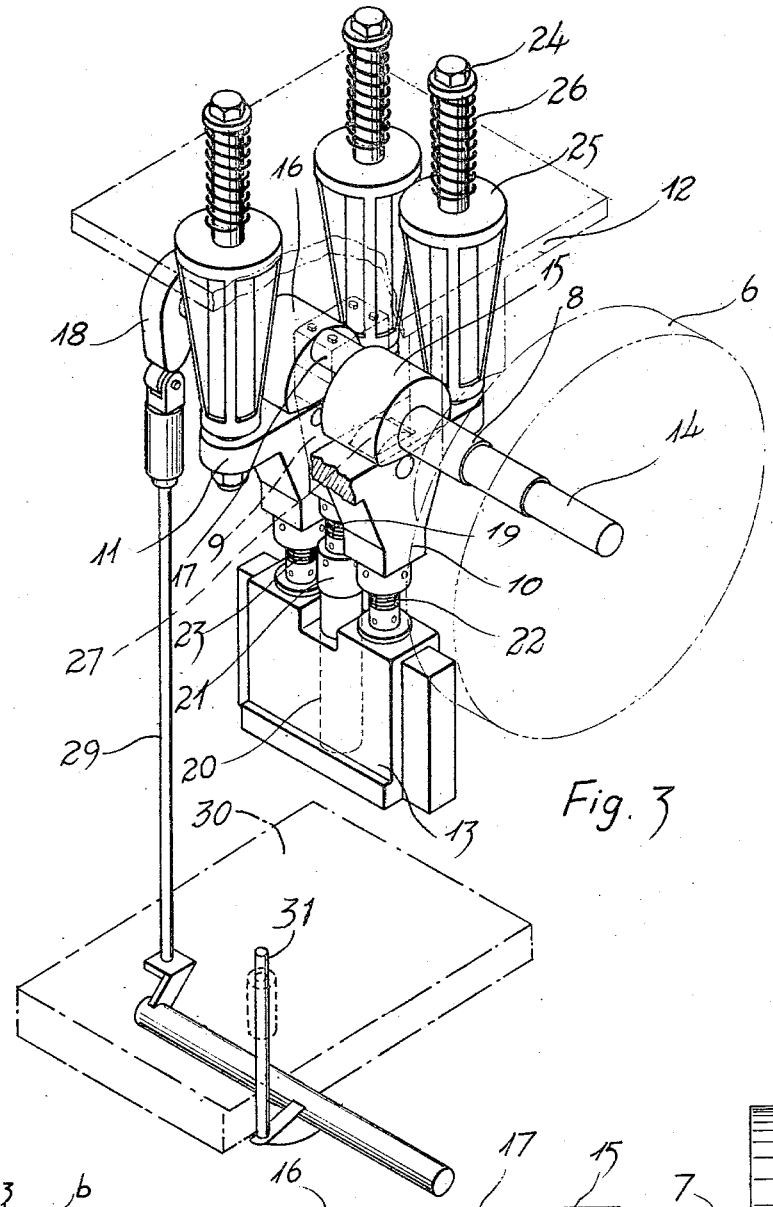
FIG. 3 is a fragmentary perspective view illustrating the relationship of the crank and the pressure head shown in FIG. 2.

Referring now to FIGS. 2 and 3, there is shown a preferred embodiment in accordance with the present invention comprising a flywheel 6, a clutch means 7, a crank 8, a connecting rod 9, two pressure heads 10, 11, a frame 12 and a slide 13.

The crank 8 includes a crank shaft or driving shaft 14 provided with a cam 18 at one end thereof and is coupled with the flywheel 6 and the clutch means 7 at another end thereof, a crank pin 17 attached to the connecting rod 9, and two crank arms 15, 16 each having a wide longitudinal surface acting as a cam for actuating the pressure heads 10, 11 to move downwardly. Upper end of the connecting rod 9 is coupled with the crank pin 17 and has a bearing means therebetween. Lower end of the connecting rod 9 is provided with a screw rod 19 coupled with a ram 20 which can move reciprocally within a passage of the slide 13. Provided on the connecting portion between the screw rod 19 and the ram head 21 is a flexible connection of any known construction, such as that known per se and shown in Belgian Pat. No. 537,659, in order to permit the ram 21 to reciprocate within the passage of slide 13.

Under the crank arms 15, 16 of said crank 8 there are provided two pressure heads 10, 11 coupled with screw rods 22, 23 so as to connect with the slide 13. The upper portion of each pressure head 10, 11 is screwed with a stem 24 protruding through a hollow guide tube 25 provided under top plate of the frame 12 and positioned by a compression spring 26. The upper portions of said pressure heads 10, 11 are provided with a bearing means 27 therein for connecting with crank arms 15, 16 so that the pressure heads 10, 11 and the stems 24 will move downwardly when the crank arms 15, 16 are rotated by the crank shaft or driving shaft 14, and the slide 13 will then decend perform the pressing procedure while the spring 26 is accordingly compressed. The compressed spring 26 is employed to return the pressure heads 10, 11 and slide 13 to the original position.

Figure 4:
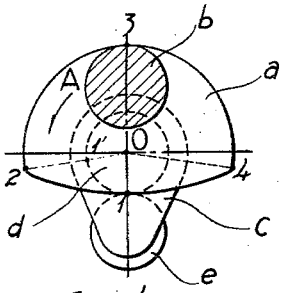
FIG. 4 is a diagrammatic view illustrating the movement of the crank shown in FIG. 2.
Figure 5:
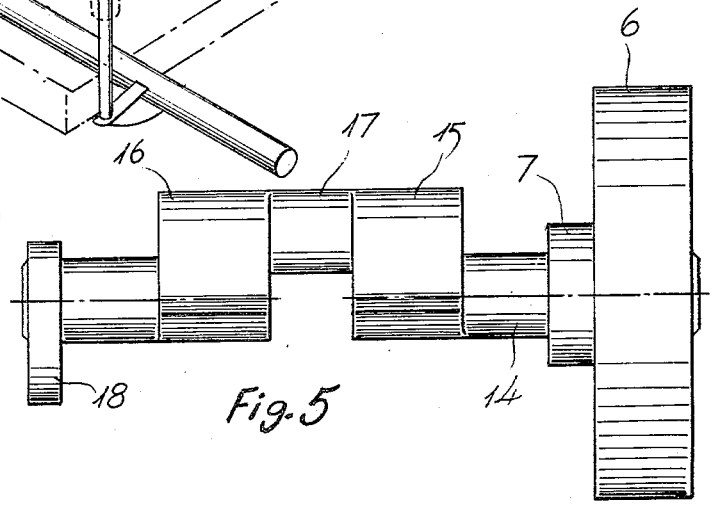
FIG. 5 is a side elevational view of the crank shown in FIG. 2 with the flywheel attached.

FIGS. 4 and 5 shows a schemmatic diagram illustrating the rotating relationships between crank shaft 14, crank arms 15, 16 and pressure heads 10, 11; crank pin and cam 18. "a" represents crank arms 15, 16 each having a wide longitudinal surface acting as a cam, "b" represents crank pin 17, "c"represents cam 18 attached to one end of said crank shaft 14, "d", and "e" represent the bearing means provided within the upper portion of said pressure heads 10, 11. When one operates the clutch device 7 the rotational energy of the flywheel 6 will be transmitted to the crank 8. Crank arms 15, 16 or 'a' drive in turn the rolling means 27 or 'e' to move downwardly while the crank pin 17 or 'b' moves along the direction of arrow 'A'. Maximun decending distance of said slide wall be reached when point 2 of said crank arms 15, 16 or 'a'contacts the bearing means 27 or 'e' of said pressure heads 10, 11. The distances between points 2, 3, 4 and rotating axis 'o' of crank arms 15, 16 are equal so that when the point 2 of crank arms 15, 16 or 'a' turns across the rolling means 27 or 'e', the slide will stay at the maximum decending point without moving until the point 4 of crank arms 15, 16 or 'e' contacts the rolling means 27 or "e". The longitudinal axis of said crank pin 17 or "b" is in alignment with the middle point 3 so that when the point 3 of crank arms 15, 16 or "a" moves to contact rolling means 27 or "e", the crank pin 17 or "b" will move to a lowest decending position thereof and actuate the connecting rod 9 so as to drive the ram 20 which is slidable within a passage of the slide 13 and perform a punching step. After the completion of the punching step the crank pin 17 or "b" moves upwardly to its highest ascending position. Slide 13, screw rods 22, 23 and pressure heads 10, 11 will return upwardly to the original position by the force of the compressed spring 26 when the point 4 of said crank arms 15, 16 or 'a' turns across the rolling means 27 or 'e'. One can easily understand that there are two power strokes generated during one turn of crank shaft 14, in which one power stroke is driven by the crank arms 15, 16 to perform the pressing step, and another is driven by the crank pin 17 to perform the punching step.

The surface of cam 18 contacts a rolling element 28 pivoted on the upper end of a connecting mechanism 29 so as to control a pushing rod 31 protruding through a bolster plate 30 to push the product away from the dies. Connecting mechanism 29 is returnable to its initial position by a spring device 40. The nose of cam 18 is positioned opposite to crank pin 17. In the preferred embodiment of the present invention, the pressing step, the punching step, and the pushing of the product away from the dies can be completed during one turn of crank shaft.

It should be understood that the foregoing merely relates to a preferred embodiment of the present invention, and that it is intended to cover all changes and modifications of the example of the invention which do not constitute departure from the spirit and scope of the invention.

What is claimed is:

1. A punching press comprising:

a frame having a bolster plate;

a slide element for pressing against said bolster plate and having a hole through the central portion of said slide in the direction of pressing;

a crank comprising a crank shaft rotatably mounted to said frame above the bolster plate and slide, said crank further comprising a crank pin carried upon two crank arms, said arms having identical planar profiles in the plane perpendicular to said crankshaft and having circumferential bearing surfaces;

a flywheel and clutch assembly mounted at one end of said crank shaft;

a cam attached to the end of said crankshaft which is opposite said flywheel and clutch assembly;

lever means movably mounted on said frame and actuated by said cam to eject finished work;

two pressure rods, said rods having bearing means at an upper end, the lower ends of said rods being attached to said slide with one rod on each side of said hole in the slide;

spring means, attached between the upper ends of said pressure rods and the frame, said spring means providing resilient bias of the rods and slide to an upward position, and resiliently retaining said rods and said slides in said upward position;

a punching ram slidingly movable within the hole in the slide; and a connecting rod mounted on said crank pin and pivotally connected to said punching ram, said two pressure rods being spaced on each side of the connecting rod with the upper bearing ends of said rods in contact with the circumferential bearing surfaces on the respective crank arms, whereby rotation of said crank shaft causes the crank arms to force the pressure rods downward, thereby forcing said slide against said bolster plate so as to provide a pressing stroke, said crank pin being located within the profile of said crank arms to provide a punching stroke for said connecting rod and said ram, whereby both pressing and punching strokes are provided during one rotation of said crank shaft.

2. A punching press as claimed in claim 1, wherein the upper portion of said presure heads is provided with a rolling means contacting with the surface of said crank arms.

3. A punching press as claimed in claim 1, wherein the distances between any point on said surface of said crank arms and the rotating axis thereof are equal; the longitudinal axis of said crank pin being in alignment with the middle point of said surface of said crank arms; the upper end of the surface of said crank pin being flush with the upper end of said surface of said crank arms; and nose of said cam being opposite to said crank pin whereby to enable the pressing step, punching step and pushing the product away from the dies to be completed during one turn of said crank shaft.

* * * * *